United States Patent [19]

Rose

[11] 4,203,761

[45] May 20, 1980

[54] PROCESS OF SMELTING WITH SUBMERGED BURNER

[75] Inventor: Robert N. Rose, Darien, Conn.

[73] Assignees: Robert C. LeMay, Lafayette Hill; Earl G. Mills, Downingtown, both of Pa.; Chester S. Stackpole, Elizabeth; Harold Massey, Ridgewood, both of N.J. ; part interest to each

[21] Appl. No.: 807,567

[22] Filed: Jun. 17, 1977

Related U.S. Application Data

[63] Continuation of Ser. No. 334,225, Feb. 21, 1973, abandoned.

[51] Int. Cl.[2] ..... C21B 11/00

[52] U.S. Cl. ..... 75/40; 75/92

[58] Field of Search ..... 75/40, 38, 24, 43, 44, 75/92

[56] References Cited

U.S. PATENT DOCUMENTS

| | | | |
|---|---|---|---|
| 2,923,615 | 2/1960 | Pearce | 75/40 |
| 3,313,618 | 4/1967 | Feinman et al. | 75/40 |

FOREIGN PATENT DOCUMENTS

| | | | |
|---|---|---|---|
| 1046675 | 10/1966 | United Kingdom | 75/40 |

*Primary Examiner*—M. J. Andrews
*Attorney, Agent, or Firm*—Leonard L. Kalish

[57] ABSTRACT

A furnace for melting, refining or processing metals and for the reduction of ores, having a refractory or graphitic bottom and side-walls and having a roof, and having a feed-entrance for introducing the unmelted metal feed-material into the furance from above the level of the molten metal, and said furnace having a molten-metal exit, and internal-combustion burners extending downwardly through the roof of the furnace with their discharge ends substantially below the melt-level and with their other ends outside the furnace. Each of the burners has a refractory or metallic combustion chamber and a metallic liquid coolant-jacket surrounding said combustion chamber, with the coolant-inlet and the coolant-outlet of the jacket being near the other end of the burner, outside the furnace. The burner has a conduit for a fuel supply and a conduit for a combustion-supporting-gas supply, with the respective inlets thereof at the outside end of the burner and with the discharge terminals thereof disposed within said combustion-chamber in operative juxtaposition to each other, and ignition means in operative juxtaposition to said terminals of the fuel conduit and of the combustion-supporting-gas conduit, respectively.

6 Claims, 10 Drawing Figures

1
2
3
4
7-a
7-b
8
9
10
11
12
13
14
15
16
17
18
19
20
21
22
23
24

Fig. 3.
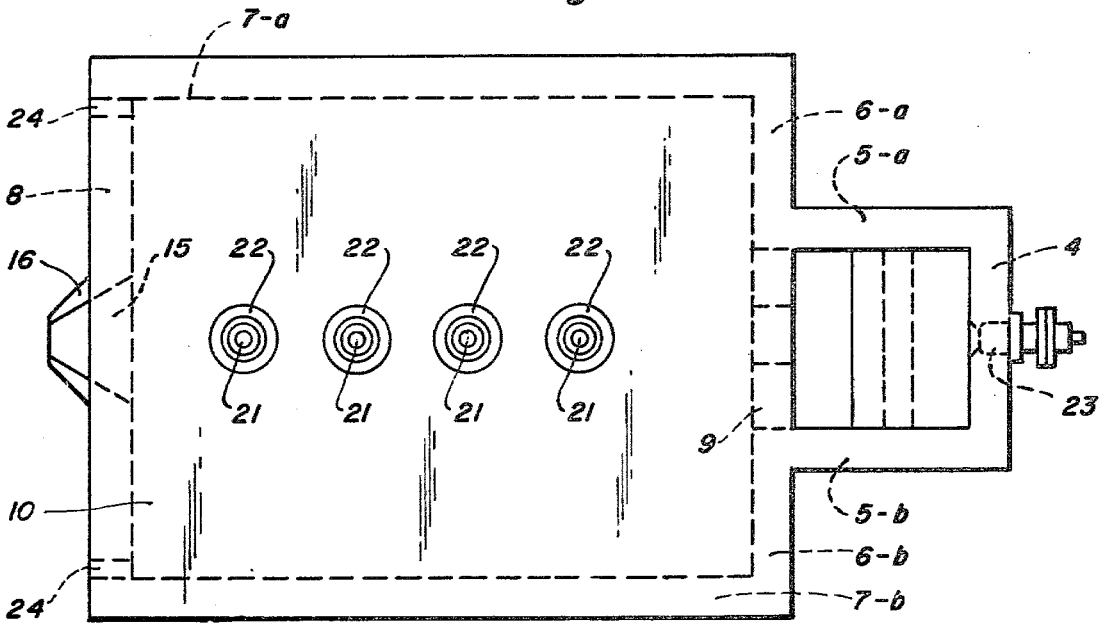
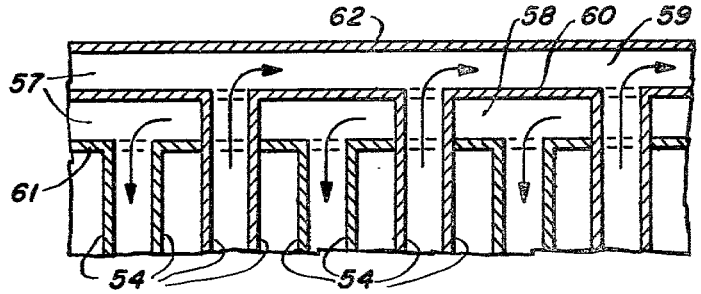
Fig. 10.
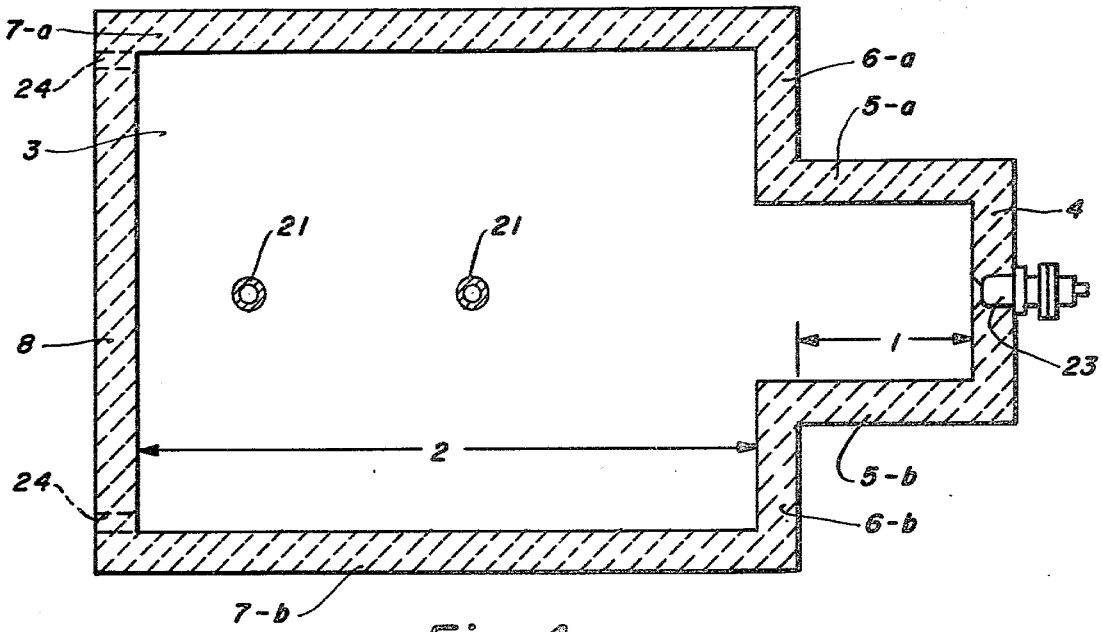
Fig. 4.

Fig. 6.
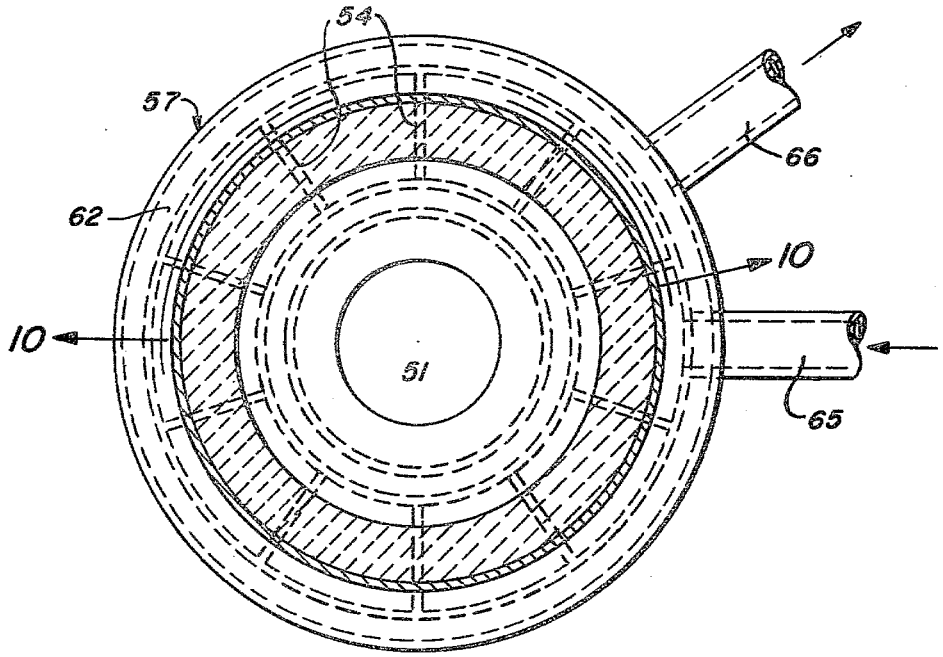
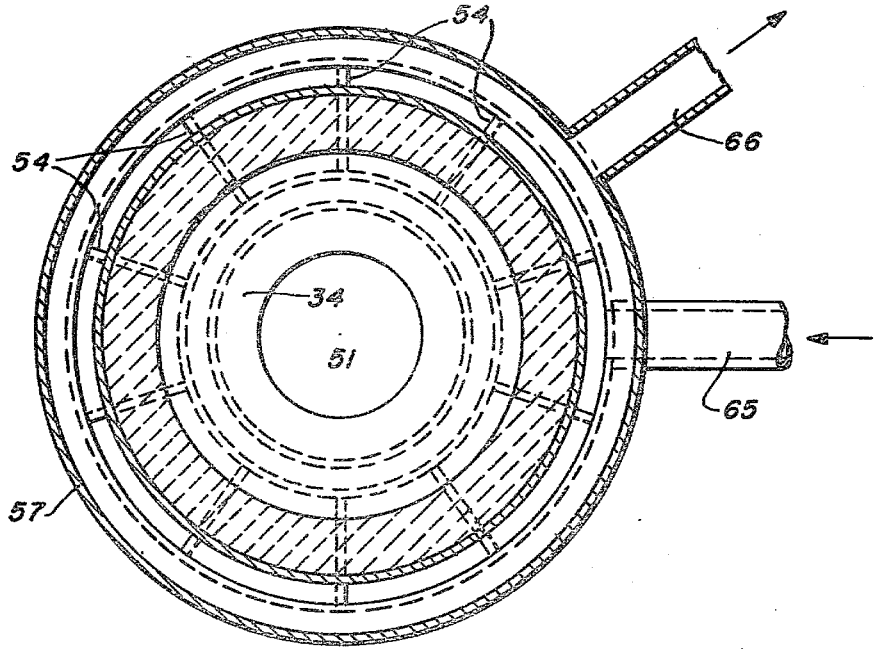
Fig. 7.

Fig. 8.
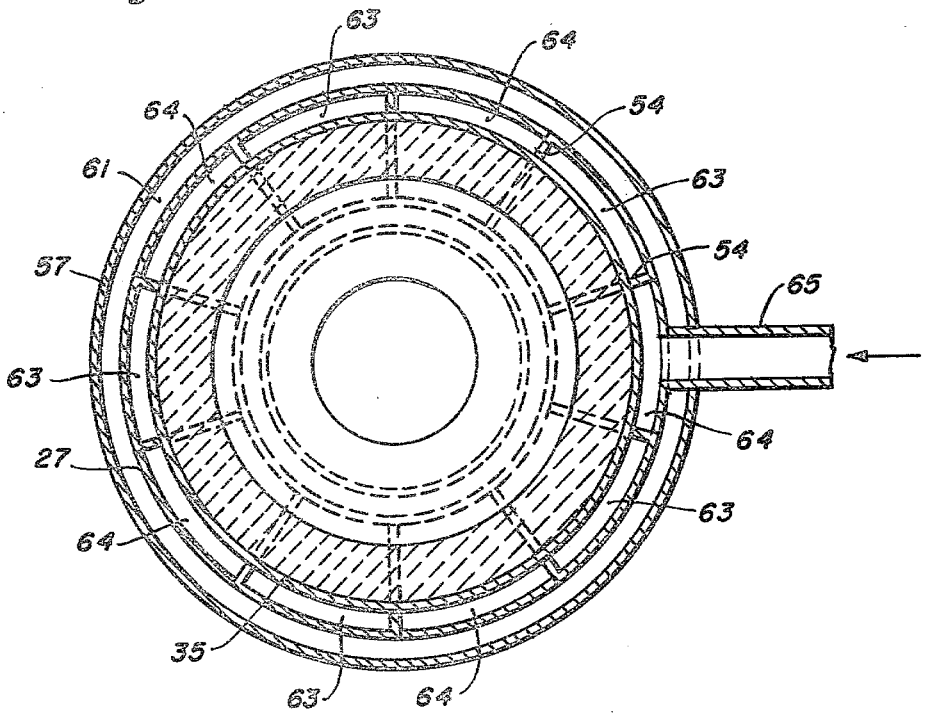
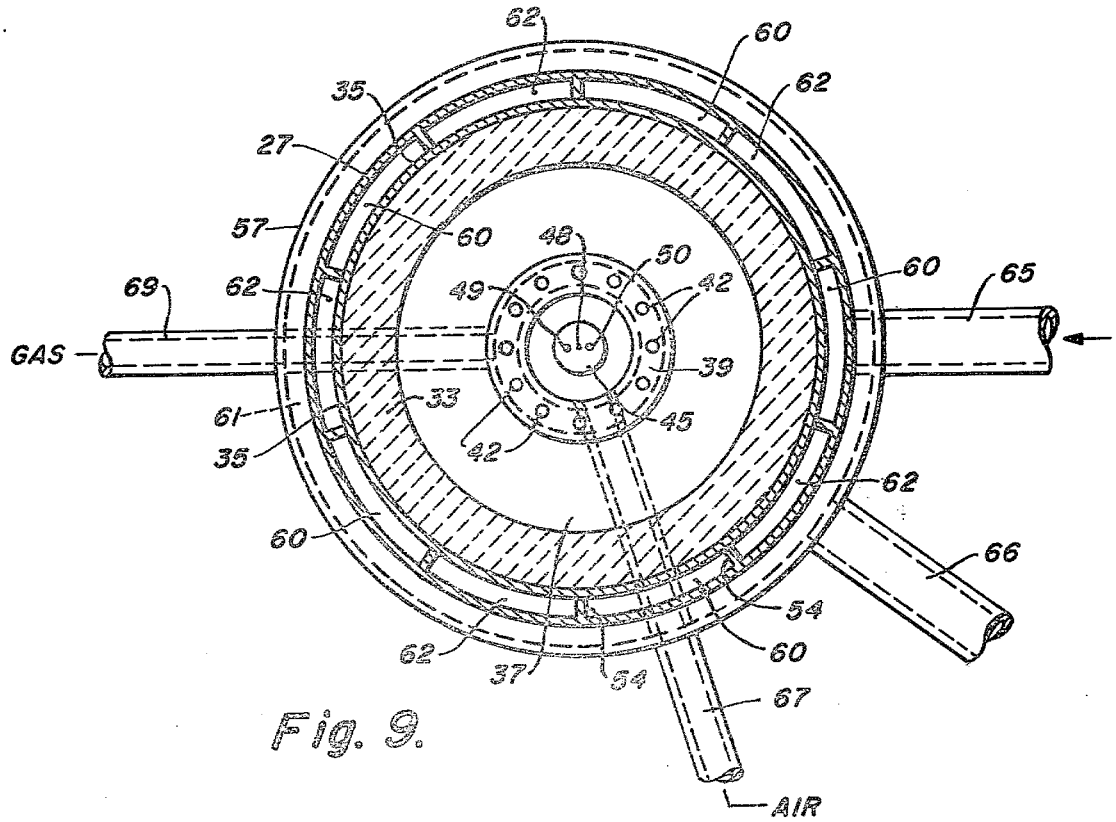
Fig. 9.

PROCESS OF SMELTING WITH SUBMERGED BURNER

This is a continuation of application Ser. No. 334,225 filed Feb. 21, 1973, now abandoned.

THE FIELD OF THE INVENTION

The field of the present invention is in the melting, refining and processing of ferrous and non-ferrous metals, with or without a simultaneous alloying thereof with other metals and with or without the introduction of other ingredients into the molten metal to affect the composition or characteristics of the end-product, and the field of the present invention is also in the reduction of ores of metals.

The field of the present invention is more particularly such furnaces in which the heat required for melting the metal and for keeping it molten is supplied by submerged internal-combustion burners which discharge the hot products of combustion substantially below the level of the melt or "metal-line", thereby to agitate and stir and circulate the melt within itself so as to achieve a uniform composition and uniform characteristics throughout the finished end-product.

The term "internal-combustion burner" as used herein means a burner to which fuel and combustion-supporting-gas are supplied to an internal combustion chamber in which the combustion takes plce and is substantially completed and from the discharge end of which burner the hot products of combustion exit substantially beneath the level of the melt. As shown by FIG. 1, none of the interaction between the fuel and oxygen takes place below the bottom of the pool of molten metal.

The fuel and the combustion-supporting-gas are supplied at a pressure substantially higher than the static pressure of the melt at the depth thereof at which the burner discharges the hot products of combustion.

The word "oxygen" as used hereinafter is intended to encompass air as well as oxygen-enriched air and also oxygen alone and a mixture of oxygen and an inert gas, and the word "melt" is intended to encompass a pool of molten metal and also a molten pool of an ore thereof and also a pool of a mixture of molten metal and ore, and the phrase "metal source" is intended to encompass metallic feed-material and also an ore of the metal as a feed material.

BRIEF SUMMARY OF THE INVENTION

The present invention generally contemplates a furnace including a melt-down section at one end, and a refining processing section downstream thereof, preferably with a bridge-wall separating the two sections, such bridge-wall extending downwardly from the roof of the furnace and extending into the melt to a point substantially below the melt-level or "metal-line" so as to prevent unmelted metal pieces or particles from passing from the melt-down section into the refining or processing section.

A material-feed is disposed above the melt-down section and a flue passageway extends through the upper portion of the bridge-wall which is between the roof of the furnace and the metal-line, and such flue-passageway extends into the end of the material-feed tower (or other material-feed means) near or adjacent to the metal-line in the melt-down section, so that the hot products of combustion which rise upwardly through the molten material in the refining and processing section and accumulate in said section above the metal-line will pass through such flue-passageway (in the bridge-wall) into the material-feed section or what is also the pre-heating section, so that such hot gaseous products of combustion will pass through such material-feed and pre-heating section countercurrent to the movement of solid metal pieces or particles and will pre-heat the same.

The material-supply and pre-heating section may be in the form of a flue tower, with downwardly-inclined cascading baffles extending inwardly from the sides thereof (as indicated in FIG. 1), or such material-feed and pre-heating section or means may be a fluidized bed if the solid metal particles are sufficiently small so that the hot products of combustion passing therethrough will keep the bed fluidized and moving towards the metal-line in the melt-down section, or such material-feed and pre-heating section or means may be an inclined rotary tubular section in which solid materials or particles will tumble and so feed or move towards the metal-line in the melt-down section. The aforementioned baffles in the tower-like or flue-like feed and pre-heating section are used primarily where the material to be melted is in the form of relatively small particles which can flow down through the staggered baffles. If the material to be melted is in the form of relatively large pieces, the baffles (shown in FIG. 1) may be omitted.

A suitable number of generally uniformly distributed lance-like internal-combustion burners are adjustably mounted in and extend through the roof of the refining or processing section of the furnace and are of sufficient length so that when they are adjusted for their submerged position, a substantial length of the burner will be submerged within the melt, and so that when they are retracted they may discharge the products of combustion at a point suitably above the metal-line, so as to melt any previously molten material which had solidified in the refining section during a shut-down of the furnace-operation without the molten metal having been first fully drawn off from the furnace.

One or more relatively short internal-combustion burners may be non-adjustably mounted in and extend through the side-wall of the melt-down section of the furnace at a point substantially below the metal-line. Such side-wise mounted burners may have their discharge ends or noses flush with the inner surface of the wall in which they are mounted or such noses may be set back a slight distance from such inner surface of the wall of the furnace. While such side-mounted burners are removably mounted, they need not be adjustable in relation to the furnace-wall unless there is need for projecting their noses a substantial distance into the melt and for retracting their noses at times.

Such side-mounted burners melt the incoming solid materials or particles thereof and help to keep the same molten.

A molten-metal overflow or discharge opening is provided at the metal-line in the refining section of the furnace, preferably at the downstream end thereof, followed by a suitable spout if continuous operation of the furnace is desired. If the furnace is to be operated batch-wise, then a tap-hole is provided in the wall of the refining section of the furnace at or slightly below the floor-level thereof, through which the batch of the finished melt can be withdrawn;- such tap-hole being plugged for the next batch. By providing the discharge-opening and the spout above the melt-line or metal-line, molten metal may be drawn off by tilting the furnace.

BRIEF DESCRIPTION OF THE DRAWINGS

FIG. 3 represents a top plan view of the furnace shown in FIG. 1.

FIG. 4 represents a fragmentary horizontal cross-sectional view on line 4—4 of FIG. 1.

FIG. 6 represents a cross-sectional view on line 6—6 of FIG. 5.

FIG. 7 represents a cross-sectional view on line 7—7 of FIG. 5.

FIG. 8 represents a cross-sectional view on line 8—8 of FIG. 5.

FIG. 9 represents a cross-sectional view on line 9—9 of FIG. 5.

FIG. 10 represents a fragmentary cross-sectional view on the circular line 10—10 on FIG. 6; but shown in planar development.

DETAILED DESCRIPTION OF THE INVENTION

Figures 1, 2:
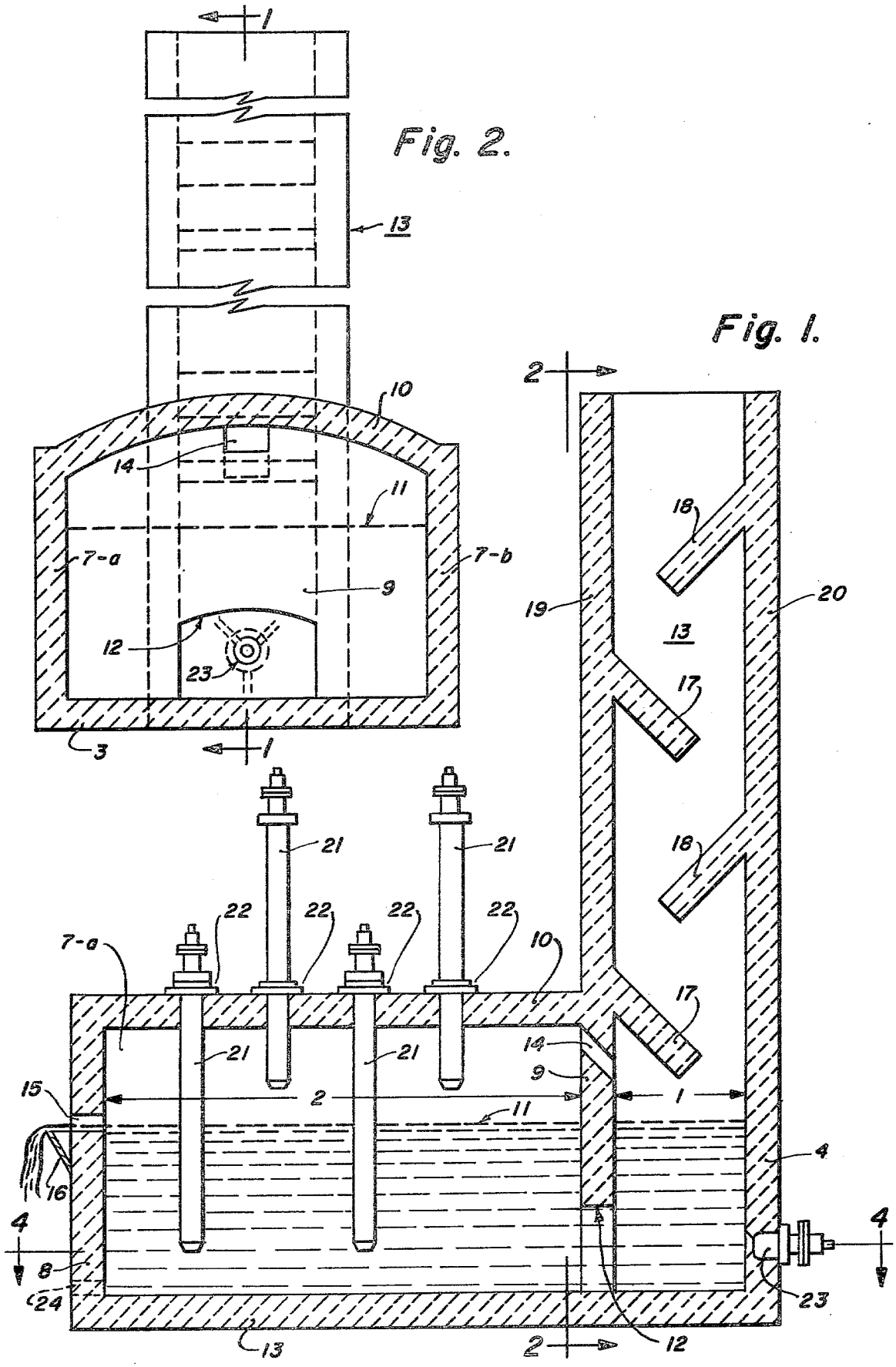
FIG. 1 represents a somewhat schematic cross-sectional view of a furnace representing an embodiment of the present invention.
FIG. 2 represents a vertical cross-sectional view on line 2—2 of FIG. 1.

In the embodiment illustrated by the drawings, the furnace includes a melt-down section 1 and a refining or processing section 2 downstream thereof. The melt-down section 1 and the processing section 2 have, in common, an imperforate refractory bottom or floor 3 (FIGS. 1 & 3). The melt-down section 1 has a refractory end-wall 4 and side-walls 5-*a* and 5-*b*. Refractory end-walls 6-a and 6-b at the upstream end of the processing section 2 extend from the side-walls 5-*a* & 5-*b* (respectively) of the melt-down section 1 to the refractory side-walls 7-*a* & 7-*b* of the processing section 2, and the refractory end-wall 8 at the downstream end of the processing section 2 extends between the downstream ends of the side walls 7-*a* & 7-*b* as indicated in FIGS. 1, 2, 3 & 4.

A bridge-wall 9 extends downwardly from the roof 10 of the processing section 2, between the upstream end-walls 6-*a* & 6-*b* thereof, to a point substantially below the metal-line 11, with the lower end 12 of the bridge-wall being sufficiently above the floor 3 to permit the free flow of molten metal from the melt-down section 1 into the processing or refining section 2 (FIGS. 1 & 2) and extends into the melt to a point sufficiently below the metal-line 11 (or sufficiently close to the floor 3 of the furnace) as to prevent unmelted pieces or particles of metal from passing from the melt-down section 1 into the refining section 2.

The roof 10 may be arched as indicated in FIG. 2 or it may be flat.

The upstream end-walls 6-*a* & 6-*b* of the processing section 2 and the bridge-wall 9 are formed in direct continuation of each other.

The material-feed and pre-heating tower and flue 13 extends upwardly from and may be formed in direct continuation of the end-wall 4 and side-walls 5-*a* & 5-*b* of the melt-down section 1 and the end-walls 6-*a* & 6-*b* of the processing section 2 and the bridge-wall 9, as indicated in FIGS. 1, 2 & 3.

A flue-opening 14 extends from the processing section 2 to the material-feed and pre-heating flue 13 through the bridge-wall 9, from a point near the roof 10 in the processing section to a point in the material-feed and pre-heating flue 13 which is near the melt-line 11, so that the hot products of combustion which accumulate in the procession section 2 (between the metal-line 11 and the roof 10) will flow into the bottom of the material-feed and pre-heating flue 13 approximately at a point near where the solid metal pieces or particles are delivered to the metal-line 11 in the melt-down section 1, and so that the hot products of combustion which so come through the flue passageway or opening 14 will pass outwardly through the material-feed 13 counter-current to the movement of the solid metal pieces or particles so as to pre-heat the same.

The lowermost metal pieces or particles in the material-feed may be melted by the hot gases coming through the flue-passage 14 plus the hot gases of combustion issuing from the internal-combustion burner or burners in the melt-down section 1 (described hereinafter).

Opposite downwardly inclined baffles 17 & 18 extend inwardly from the opposite walls 19 & 20 of the material-feed and pre-heating tower and flue 13, in the manner indicated in FIG. 1, so as to cause the solid material to cascade down through the material-feed and pre-heating tower and flue 13 in such a way as to maximize the exposure of the solid material pieces or particles to the hot products of combustion rising upwardly through the tower and flue 13.

Figure 5:
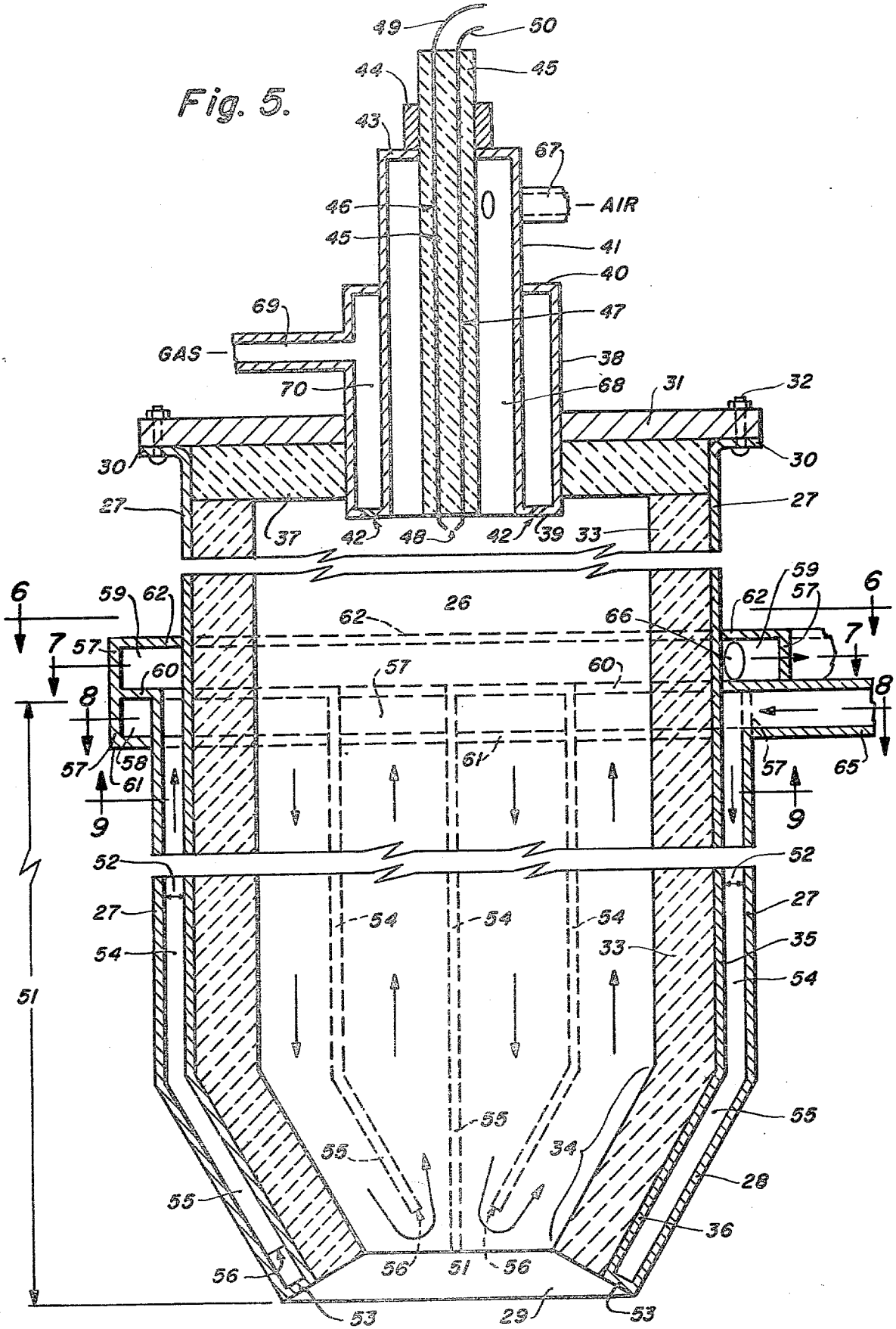
FIG. 5 represents a somewhat schematic longitudinal cross-sectional view of an embodiment of the internal-combustion burner.

A plurality of relatively long internal-combustion burners 21 (one embodiment of which is shown in FIG. 5) extend downwardly through the roof 10 of the refining or processing section 2 of the furnace and are adjustably mounted thereto in generally gas-tight relation therewith by stuffing-gland-like collars or means 22 schematically indicated in FIG. 1.

The burners 21 may be vertically adjusted and may be retracted upwardly (as shown in FIG. 1) so that they discharge the hot products of combustion above the metal-line 11 and so that they may be extended downwardly and submerged in the melt, thereby to discharge the hot products of combustion susbstantially below the metal-line or in proximity to the floor of the furnace.

The burners 21 are retracted if its is desired to shut down the furnace with molten material left therein, which will solidify during the shut-down period. When the furnace is started up again, after such shut-down period, the withdrawn burners 21 are started up and made to fire or to discharge the hot products of combustion above and in sufficient proximity to the upper surface of the theretofore solidified material, gradually to melt the same, and are then lowered into the molten material either in a single step or gradually as the material is melted, until they reach their fully submerged position shown in FIG. 1.

Some of the burners 21 may be withdrawn and rendered inoperative while others are submerged and operate, if less than all the burners 21 will provide sufficient heat to keep the material molten and at a sufficiently high temperature for the refining, alloying, compounding or other processing of the melt.

One or several short side-mounted internal combustion burners 23 are extended through the side-wall or side-walls of the melt-down section 1 of the furnace, substantially below the metal-line 11, as indicated in FIGS. 1 & 4 to cause the hot products of combustion discharged from the burners 23 first to melt the incoming feed of solid material or particles and then to keep the materials molten in the melt-down section 1 and also to contribute to the hot products of combustion rising upwardly through the pre-heating tower and flue 13. The submerged side-mounted burner or burners 23 are provided only when the furnace is either operated continuously without any shut-down while there is molten metal within the furnace above the level of the side-mounted burners 23 or where the furnace is operated batch-wise with a complete withdrawal of the molten material through the tap-hole 24 or where the molten material is withdrawn through a tap-hole 24 to a point below the level of the side-mounted burners 23 if such withdrawal is for the purpose of a shut-down.

The overflow-opening 15 in the downstream end-wall 8 of the furnace is at a point which determines the location of the metal-line 11 in the continuous operation of the furnace. The spout 16 is carried by and extends outwardly from the end-wall 8 of the furnace to a sufficient distance so as to permit the metal flowing over the lip of the spout to be readily caught by a ladle, mold or other catchment vessel which may be used for receiving the finished molten metal.

For batch-wise operation, the metal out-flow-opening 15 may be located substantially above the melt-line 11, and finished molten metal may be drawn off through the opening 15 by tilting the furnace about a suitable transversely-extending horizontal pivot or fulcrum beneath the floor of the furnace suitably located therealong, so as to permit the upstream end of the furnace to be raised (by a suitable hoist or hydraulic lift or the like) in relation to the downstream end of the furnace so as to tilt the furnace at an angle suitable for such drawing off of finished molten metal. The tilting pivot or fulcrum may be beneath the steel structure supporting the bottom or floor 3 of the furnace or the tilting pivot or fulcrum or may be located at a suitable point substantially above the floor 3, but in such case the pivotation would be provided by two opposite co-axial trunions extending outwardly from the side-walls **7-*a* & 7-*b* (secured to the steel frame of the furnace in which the refractory bottom and walls are mounted). If it is desired to tilt or rotate the furnace for drawing off the finished molten metal, the material-feed or pre-heating flue 13** would be materially shortened and the gases discharged therefrom vented into a suitable hood beneath or connected to a suitable chimney or stack.

When the material to be fed to the furnace is in relatively small pieces or particles, it may be fed to the furnace by means of an inclined rotary-drum pre-heater, or if the particles are sufficiently small and generally uniform, the material may be fed to the furnace through a fluidized bed of such particles. In each case, the hot products of combustion from the burners 21 & 23 pass through such rotary drum and through such fluidized bed.

The herein described metalurgical furnace may also be used for the processing of metals from a direct-reduction of the ores thereof and in continuation of such direct-reduction.

The feed-material may also be sponge-iron or pre-reduced iron or other pre-reduced metals.

I may also effect the direct reduction of ores of metals, as, for instance, iron ores, by feeding the iron ore through the material-feed and pre-heating stack 13 or by feeding suitable small-particle crushed ore or suitable size pellets of the ore to the furnace, above the pool of molten iron, through a fluidized bed or through an inclined rotary pre-heating retort.

The small particle ore or the suitable-size pellets may be partly or substantially reduced in the fluidized bed, as, for instance, to a reduction of 65 to 85% of Fe or to a reduction of 85 to 90% of Fe, which partly reduced ore is then fed to the pool of molten iron beneath the discharge end of the fluidized bed or inclined rotary-drum where it is further reduced by the below-mentioned reducing atmosphere, or the small-particle ore or pellets of ore may be only pre-heated in the fluidized bed or in the inclined rotary drum or reduced to a much lesser extent than above mentioned, and the so pre-heated ore or lesser-reduced ore is then fed to the pool of molten iron beneath the discharge end of the fluidized bed or inclined rotary drum where it is then further reduced.

I may provide the reducing atmosphere by supplying air (or other combustion-supporting gas) through the supplying-pipe 67 of the internal combustion burners (21 and/or 23) at a rate which is sufficiently less than the stoichiometric quantity thereof in relation to the fuel being fed to said burners, so that the gases issuing from the submerged discharge ends of the burners will be generally reducing gases, while still supplying sufficient heat needed for the reduction of the ore and/or for the fusion or melting of the reduced material. The interaction between the fuel and oxygen of which the non-stoichiometric proportions thereof are capable is substantially completed within the combustion-chamber 26 of the internal combustion burner shown in FIG. 5.

I may also provide a reducing atmosphere by injecting into the molten pool of metal or in the zone point immediately above the metal-line thereof, additional gaseous fuel (or liquid fuel), with or without a concurrent supply of steam mixed therewith. The so produced reducing atmosphere may be used by itself without the aforementioned reducing gases from the internal-combustion burners or in conjunction with such burner-produced reducing gases, to augment the latter.

The term "non-circulating" in the claims is in contradistinction to a pool or bath of molten metal which circulates in a closed cycle in an annular or torroidal orbit about a vertical axis, as for instance in the ring-hearth furnace disclosed in British Pat. No. 1,046,675.

FIGS. 5 to 9 illustrate an embodiment of the internal-combustion burners 21 and 23;- the two (21 & 23) differing from each other only in their length beyond the combustion-chamber 26 thereof.

The burners (21 & 23) include a generally cylindrical outer metallic shell 27, whose discharge end 28 may be tapered inwardly towards the discharge end 29 of the burner. The shell 27 has an outwardly extending annular flange 30, preferably formed integrally therewith, to which the closure or head 31 is bolted by means of peripherally distributed bolts 32, so as to permit the periodic opening of the outer end of the shell 27 when it is desired to remove or replace the refractory lining thereof. A preferably pre-formed cylindrical refractory liner 33 is mounted within and supported by the shell 27. The liner 33 has a conical discharge end or nose portion 34 which may also be formed as a separate piece. The refractory liners 33 & 34 are fitted sufficiently close to the inner metal shells 35 & 36 so as to obtain a good heat-transference from the refractory liners to such metal shells.

An outer refractory closure disc 37 is provided across the outer end of the cylindrical refractory liner 33 so as to complete the refractory enclosure of the combustion chamber 26;- the refractory disc 37 being held in place by the head 31.

A cylindrical fuel-supply shell 38 extends through the head 31 and may be welded thereto by means of a suitable flange or stuffing-gland or the like (not shown). The shell 38 extends inwardly from the head 31 to a distance sufficient to reach the inner surface of the refractory disc 37, and is provided with an in-turned inner terminal flange 39. The outer end of the cylindrical shell 38 is provided with an in-turned flange 40. A cylindrical member 41 extends through the outer flange 40 of the fuel-shell 38 and is preferably welded thereto by a suitable fillet weldment (not shown). The inner end of the cylindrical member 41 terminates at the inner periphery of the in-turned flange 39 and is preferably welded thereto. A suitable number and size of equi-distantly spaced fuel-exit holes 42 are provided in the in-turned terminal flange 39, either parallel to the axis of the burner or preferably inclined inwardly at a suitable angle, so as to discharge the fuel in a number of inwardly-directed jets.

The fuel discharge holes 42 are preferably also inclined tangentially so as to cause the jets of fuel issuing therefrom to create a swirling turbulence within the combustion-chamber conducive to rapid and complete combustion.

The outer end of the cylindrical member 41 is closed by the closure member or disc 43 having a central opening therein. A gland-like collar 44 is welded to or formed integrally with the disc 43 (by casting or the like), a high-temperature ceramic electrode-encasing rod 45 extends through the gas-pressure-tight stuffing-gland 44 and is adjustably supported therein, so that it can be extended into the cylindrical member 41 to the desired extent for optimum ignition. A pair of ignition electrodes 46 & 47 are insulatedly embedded in and extend through the insulating ceramic rod 45, with their innermost ends extending therebeyond and angled towards each other to provide a spark-gap 48 in operative juxtaposition to the fuel-jets issuing from the fuel-exit holes 42. Lead-wires 49 & 50 extend from the electrodes 46 & 47 to any suitable source of intermittent or continuous current of sufficiently high voltage to provide a suitable ignition spark at the gap 48.

The nose-section 51 of the burner may be long, as in the case of the burners 21, or may be very short, as in the case of the side-mounted burners 23. The nose-section 51 of the burner is surrounded by the inner metallic cylindrical shell 35 and conical nose-portion 36 thereof generally parallel to the outer metallic shells 27 & 28;- providing an annulus-shaped space 52 between such inner and outer metallic shells. The innermost ends of the conical shell-portions 28 & 36 are bridged and connected by a transverse conical closure 53 welded to such innermost ends. Circumferentially-spaced longitudinally extending radial divider plates 54 are provided in the space 52 between the inner metallic shell portions 35 & 36 and the outer metallic shell portions 27 & 28. The innermost portions 55 of the plates 54 angle inwardly to correspond to the angle of the conical shell-portions 28 & 36, and terminate at 56, short of the conical closure-member 53 so as to leave the fluid-passageway between the ends 56 of such divider plates 54 adjacent the conical closure-member 53.

A cylindrical member 57 surrounds the outer end of the outer cylindrical shell 27 to form the annulus-shaped lower header-chamber 58 for the incoming or in-flowing collant and to form the upper annulus-shaped header chamber 59 for the outwardly flowing coolant.

The in-flow header-chamber 58 is bounded by the upper annulus-shaped disc 60 and the lower annulus-shaped disc 61. The out-flow header-chamber 59 is bounded by the upper portion of the cylindrical member 57 and the annulus-shaped disc 60 and the annulus-shaped disc or ring 62 welded to the upper end of the cylindrical shell 57. The upper ends alternating pairs of radial separators 54 extend through corresponding slots 63 in the annulus-shaped disc or ring 61 and are welded to the edges of such slots and have their upper ends welded to the edges of slots 64 in the annulus-shaped disc or ring 60. The slots 63 & 64 alternate with each other.

The liquid coolant, generally cold water, enters through the in-flow pipe 65 into the annulus-shaped header 58, and from there the coolant flows downwardly between the outer shell (27 & 28) and the inner shell (35 & 36), through alternating longitudinal passageways formed by the separator plates 54, until they reach the lower ends of such shells, where the coolant flows to the adjacent up-passageway (as indicated by the arrows in FIG. 5), which up-passageways discharge into the upper annulus-shaped header 59, from which the coolant flows outwardly through the out-flow pipe 66 (as indicated in FIGS. 5 to 9).

Air or oxygen (or any suitable combustion-supporting mixture) is delivered to the annulus-shaped space 66 between the outer air shell 41 and the ceramic electrode-holder 45. Gaseous (or liquid) fuel is delivered to the generally annulus-shaped space 67 between the cylindrical shell 41 and the outer cylindrical shell 38, as indicated in FIGS. 5 & 9.

If it is desired to use a liquid fuel (as, for instance, any suitable fuel oil), the ceramic electrode-bearing rod 45 is removed, and in its place a liquid-fuel nozzle-assembly is inserted with its atomizing nozzle-tip at approximately the same location as the gap 48 between the ends of the electrodes 46 & 47. When using such fuel-nozzle-assembly, the ignition for such atomized fuel-oil may be provided by any suitable manual ignition means or other suitable ignition means. In such event, the outer annulus- shaped chamber 70 and the supply-pipe 69 thereto may be eliminated or just closed off.

As used in the following claims, the term "processing" is intended also to include refining.

It should be understood that the present disclosure is for the purpose of illustration only and that this invention includes all modifications and equivalents which fall within the scope of the appended claims.

I claim the following:

1. A metalurgical process which includes maintaining a melt-down non-circulating pool in a furnace by interacting a fluid fuel and oxygen in a heat-insulating refractory combustion chamber of an internal-combustion burner separate and distinct from the furnace and having its discharge below the metal-line and above the bottom of the pool of molten metal, the interaction between the fuel and the oxygen, of which the same are capable, being substantially completed within said combustion chamber, and with none of the interaction between the fuel and oxygen taking place below the bottom of the pool of molten metal, and injecting into the melt-down pool substantially below its top and above its bottom the resultant hot gases issuing from said combustion-chamber and passing such hot gases upwardly through the melt-down pool, and feeding material to be melted to said melt-down pool and passing the hot gases which have risen through the melt-down pool through said material-feed counter-current to the feeding movement thereof, thereby causing said melt-down pool to be augmented by the melting of such feed-material, causing the excess of melt to flow from said melt-down non-circulating pool into a processing-pool in the furnace and interacting a fluid fuel and oxygen in a heat-insulating refractory combustion chamber of an internal combustion burner separate and distinct from the furnace and having its discharge below the top and above the bottom of the melt in the processing pool, the interaction between the fuel and the oxygen, of which the same are capable, being substantially completed within said combustion chamber, and with none of the interaction between the fuel and oxygen taking place below the bottom of the processing pool, and injecting into the melt in the processing-pool, substantially below its top and above its bottom the resultant hot gases issuing from said combustion-chamber and passing such hot gases upwardly through the melt in the processing-pool, and causing said hot gases which have risen through said processing-pool to merge with the hot gases which have risen through the said melt-down pool so as to pass therewith through the aforementioned material-feed, and drawing off metal from said processing-pool.

2. A metalurgical process which includes maintaining in a furnace a non-circulating pool of molten metal having an oxide content and reducing its oxide content by incompletely burning a fluid fuel with oxygen in a heat-insulating refractory combustion-chamber of an internal combustion burner separate and distinct from the furnace and having its discharge below the top and above the bottom of the pool of molten metal, the interaction between the fuel and the oxygen, of which the same are capable, being substantially completed within said combustion chamber, and with none of the combustion taking place vertically below the bottom of the pool of molten metal, and passing the hot products of such incomplete combustion upwardly through the pool of molten metal.

3. A metalurgical process which includes maintaining in a furnace a non-circulating pool of molten metal having an oxide content and reducing its oxide content by incompletely burning a fluid fuel with oxygen in the presence of steam in a heat-insulating refractory combustion-chamber of an internal-combustion burner separate and distinct from the furnace and having its discharge below the top and above the bottom of the pool of molten metal, the interaction between the fuel and the oxygen, of which the same are capable, being substantially completed within said combustion chamber, and with none of the combustion taking place vertically below the bottom of the pool of molten metal and passing such hot products of such incomplete combustion upwardly through the pool of molten metal, with the oxygen supplied to the combustion-chamber of the burner being sufficiently less than the stoichiometric quantity thereof in relation to the fuel being fed to the combustion-chamber so that the gases issuing from the submerged discharge end of the burner will include reducing gases and will still supply sufficient heat for maintaining the metal in a molten condition.

4. A metalurgical process according to claim 3, in which the hot products of the incomplete combustion which have arisen through the pool of molten metal are passed through the material being fed to pool of molten metal counter-current to the direction of the feeding travel thereof.

5. A metalurgical process according to claim 2, in which the hot products of combustion which have risen through the molten metal are passed through the material being fed to the pool of molten metal counter-current to the direction of the feeding travel thereof.

6. A metalurgical process which includes maintaining, in a furnace, a non-circulating melt of a metal-source having a non-metallic content, and lessening its non-metallic content by chemically reacting therewith the unreacted content of the generally homogeneous hot gaseous products of generally uniform composition resulting from the non-stoichiometric combustion-reaction between a fluid-fuel and oxygen in a heat-insulating refractory combustion-chamber of an internal-combustion burner separate and distinct from the furnace and having its discharge above the bottom and substantially below the top of the melt, and with none of the interaction between fuel and oxygen taking place below the bottom of the melt, and with the interaction between the fuel and oxygen of which the non-stoichiometric proportions thereof are capable being substantially completed within said combustion-chamber, and passing the resultant hot gaseous products of such non-stoichiometric combustion of generally homogeneous and uniform composition upwardly through the melt to effect a chemical reaction between the non-metallic content of the melt and the unreacted content of the hot gases resulting from such non-stiochiometric interaction between fuel and oxygen, thereby to lessen such non-metallic content of the melt, and such hot gaseous products of said non-stoichiometric combustion-reaction supplying sufficient heat for maintaining the metal in a molten condition.

* * * * *